US005425653A

United States Patent [19]

Koiso

[11] Patent Number: 5,425,653

[45] Date of Patent: Jun. 20, 1995

[54] CONNECTOR ASSEMBLY WITH CONNECTION CONFIRMATION MECHANISM

[75] Inventor: Yozo Koiso, Tokyo, Japan

[73] Assignee: The Furukawa Electric Co., Ltd., Tokyo, Japan

[21] Appl. No.: 303,682

[22] Filed: Sep. 9, 1994

[30] Foreign Application Priority Data

Sep. 11, 1993 [JP] Japan ..... 5-054143 U

[51] Int. Cl.[6] ..... H01R 4/50

[52] U.S. Cl. ..... 439/347; 439/489; 439/352

[58] Field of Search ..... 403/405.1, 409.1, 410; 439/345, 347, 350, 352, 357, 358, 488, 489

[56] References Cited

U.S. PATENT DOCUMENTS

| | | | |
|---|---|---|---|
| 4,884,978 | 12/1989 | Inaba et al. | 439/352 |
| 5,207,593 | 5/1993 | Bogiel | 439/347 X |
| 5,236,373 | 8/1993 | Kennedy | 439/347 |
| 5,370,550 | 12/1994 | Alwine et al. | 439/352 |

FOREIGN PATENT DOCUMENTS 1-174881 12/1989 Japan .

*Primary Examiner*—Khiem Nguyen
*Attorney, Agent, or Firm*—Nikaido, Marmelstein, Murray & Oram

[57] ABSTRACT

A connector assembly with a connection confirmation mechanism having a male connector and a female connector. The male connector has formed on it an inclined projection which is formed at least at one side surface of the male connector and which inclines upward from the front end of the male connector to the base end. The female connector has formed in it a connection hole into which the front end of the male connector is inserted and insertion holes communicating with the inside of the connection hole. The lock member has formed on it side plates which fit into the insertion holes of the female connector so that the lock member is attached vertically movably with respect to the female connector. The side plates have formed on them elastic engagement pieces which elastically deform upon abutting with the inclined projections of the male connector and push up the lock member from the female connector by the abutting with the inclined projections and engagement grooves which enable the lock member to be pushed down into the female connector when the male connector is fit into the female connector and which enable engagement with the inclined projections.

9 Claims, 6 Drawing Sheets

RELATED ART

RELATED ART

CONNECTOR ASSEMBLY WITH CONNECTION CONFIRMATION MECHANISM

BACKGROUND OF THE INVENTION

1. Field of the Invention

The present invention relates to a connector assembly with a connection confirmation mechanism which enable visual confirmation that the male and female connectors have been completely connected with each other.

2. Description of the Related Art

When connecting male and female connectors, there is known a connector assembly with a connection confirmation mechanism which is engaged by a locking arm and also engaged by a lock member for double locking of the male and female connectors and which enables detection of incomplete connection of the male and female connectors by the lock member.

An example of this type of connector assembly with a connection confirmation mechanism is shown in FIG. 1. As shown in FIG. 1, a lock member 50 is attached pivotally to the top surface of the female connector 40. The pivot shaft of the lock member 50 has attached to it a coil spring 52, the spring force of this coil spring 52 keeping the lock member 50 constantly open upward with respect to the female connector 40. At the rear surface of the lock member 50 is provided an engagement projection 51.

The male connector 30 has a locking arm 32 formed on it.

To attach the male connector 30 to the female connector 40, the two connectors 30 and 40 are connected to each other completely and then the lock member 50 is pushed down against the spring force of the coil spring 52 to make the engagement projection 51 provided on the rear surface of the lock member 50 engage with the top surface of the male connector 30 and thereby doubly lock the two connectors 30 and 40. Whether or not the engagement projection 51 provided at the rear surface of the lock member 50 is engaged with the male connector 30 enables detection of incomplete connection of the two connectors 30 and 40.

Further, there is known the connector assembly shown in FIG. 2 as a related connector assembly with a connection confirmation mechanism. As shown in FIG. 2, the female connector **40*a* has a plate-like lock member 60 attached pivotally to it. At the front end of the top surface of the lock member 60 there are attached elastic engagement pieces 61 having engagement pawls 62. At the front end of the rear surface of the lock member 60, further, engagement projections 63 are formed projecting outward. The engagement projections 63 of the lock members 62 can be made to engage with the inside edges 41*a* of the front end of the grooves 41 provided at the top surface of the female connector 40*a*** so as to enable closure.

The male connector **30*a* fit in the female connector 40*a* has a locking arm 32*a*** formed on it.

To attach the male connector **30*a* to the female connector 40*a*, the two connectors 30 and 40 are completely connected, then the lock member 60 is pushed down to cause the engagement projections 53 provided on the rear surface of the lock member 60 to engage with the male connector 30*a* and doubly lock the two connectors 30*a* and 40*a*. Whether or not the engagement projections 63 provided on the rear surface of the lock member 60 engage with the male connector 30*a* enables detection of incomplete connection of the two connectors 30*a* and 40*a***.

In the connector assembly with the connection confirmation mechanism shown in FIG. 1, however, there was the problem that before connection of the two connectors 30 and 40, the lock member 50 would always be in the open state, so during transportation of the connector, during the work for arranging the wire harness connected to the female connector 40, etc., the lock member 50 would be damaged by mechanical force exerted on it.

On the other hand, in the connector assembly with the connection confirmation mechanism shown in FIG. 2, as shown in FIG. 3 and FIG. 4, since it was possible to make the engagement pawls 62 provided at the front ends of the elastic engagement pieces 61 formed on the lock member 60 engage with the inner edges **41*a* at the front ends of the grooves 41 provided in the top surface of the female connector 40*a* to close the member, there was the advantage that it was possible to prevent the lock member 60 from being damaged by mechanical force exerted on it during transportation of the connector, during the work for arranging the wire harness connected to the female connector 40**, etc.

However, when the two connectors **30*a* and 40*a* were incompletely connected, as shown in FIG. 4, the portion of the lock member 60 projecting upward would be small and there was no great difference from the state in which there was normal double locking, so there was the problem that it was extremely difficult to detect visually if the connectors were locked. Further, even if the two connectors 30*a* and 40*a* were connected and the lock member 60 closed, there was the problem that it was hard to confirm if the two connectors 30*a* and 40*a*** were completely doubly locked for the same reason as above when forgetting to doubly lock them.

There is also known the connector assembly shown in Japanese Unexamined Utility Model Publication (Kokai) No. 1-174881 as a connector assembly with a connection confirmation mechanism. In the connector assembly disclosed in this publication, the lock member attached to the female connector is made movable upward and downward along an elongated hole. Only when joined by the locking arm will the lock member project upward. By pushing in this lock member, double locking is achieved. According to this connector assembly, there is the advantage of easy confirmation of poor locking compared with the connector assembly of the type with the pivoting lock member shown in FIG. 1 and FIG. 2.

However, even in the connector assembly disclosed in this publication, the amount of the projection of the lock member is small and therefore there has been a demand for a connector assembly enabling reliable confirmation of poor locking.

SUMMARY OF THE INVENTION

The present invention has been made in consideration of the above problems and has as its object the provision of a connector assembly with a connection confirmation mechanism which enables extremely easy visual detection of whether the male and female connectors are completely doubly locked.

To achieve this above, the connector assembly with a connection confirmation mechanism according to the present invention is a connector assembly which has a male connector and a female connector, wherein the male connector has formed on it an inclined projection which is formed at least at one side surface of the male connector and which inclines upward from the front end of the male connector to the base end, the female connector has formed in it a connection hole into which the front end of the male connector is inserted and insertion holes communicating with the inside of the connection hole, the lock member has formed on it side plates which fit into the insertion holes of the female connector so that the lock member is attached vertically movably with respect to the female connector, and the side plates have formed on them elastic engagement pieces which elastically deform upon abutting with the inclined projections of the male connector and push up the lock member from the female connector by the abutting with the inclined projections and engagement grooves which enable the lock member to be pushed down into the female connector when the male connector is fit into the female connector and which enable engagement with the inclined projections.

Preferably, the elastic engagement pieces have formed on them engagement pawls which engage with the bottom surfaces of the front opening edges of the insertion holes when the lock member is pushed down into the female connector and engages with the top surfaces of the front opening edges of the insertion holes when the lock member is pushed up from the female connector.

Preferably, the bottom or top surface of the male connector has formed on it a locking arm which bends in a cantilever fashion and has formed on it an engagement projection, the bottom or top side of the connection opening of the female connector has formed in it a connection groove for guiding the insertion of the locking arm, and the bottom or top surface of the connection groove has formed on it an engagement step for engaging with the engagement projection of the locking arm when the male connector is fit into the female connector.

Preferably, at least one side of the male connector has the inclined projections formed on them.

A pair of the side plates of the lock member may be formed extending downward from the two sides of the top plate.

A side plate of the lock member may be formed to extend downward from one side of the top plate, a downward extending guide rod may be formed at the other side of the top plate, and the female connector may be provided with a guide hole for guiding the guide rod. It is desirable to format the bottom end of the guide rod a guide taper for abutting against the inclined projection of the male connector.

In the present invention, in the state before fitting together the male connector and the female connector, the side plates of the lock member attached to the female connector are completely pushed down into the insertion holes of the female connector and the engagement pawls of the elastic engagement pieces are made to engage with the edges of the insertion holes.

As a result, the lock member will not project out at all from the top surface of the female connector and, further, will be affixed by the engagement of the engagement pawl, so the lock member will not get in the way and it is possible to prevent damage to the lock member during transportation of the connector, during the work for arranging the wire harness connected to the female connector, etc.

Further, in the connector assembly with the connection confirmation mechanism of the present invention, it is possible to push up the lock member to the same extent as the height dimension of the male connector. Accordingly, it is possible to extremely easily detect when the two connectors are not completely connected or when the two connectors are not doubly locked by the lock member, since the lock member projects upward a large amount from the top surface of the female connector.

BRIEF DESCRIPTION OF THE DRAWINGS

The above object and features of the present invention will be more apparent from the following description of the preferred embodiments with reference to the accompanying drawings, wherein.

DESCRIPTION OF THE PREFERRED EMBODIMENTS

Below, an embodiment of the present invention will be explained in more detail with reference to the drawings.

Figure 1:
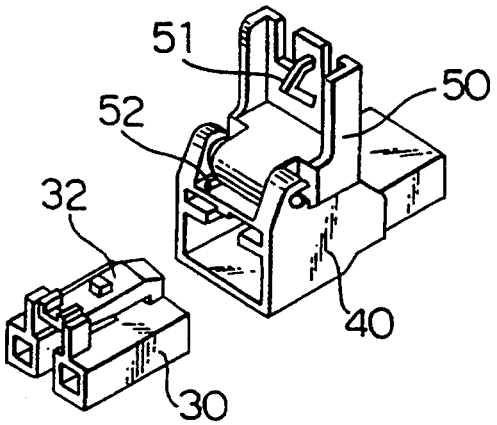
FIG. 1 is a disassembled perspective view of a connector assembly with a connection confirmation mechanism according to the related art.
Figure 2:
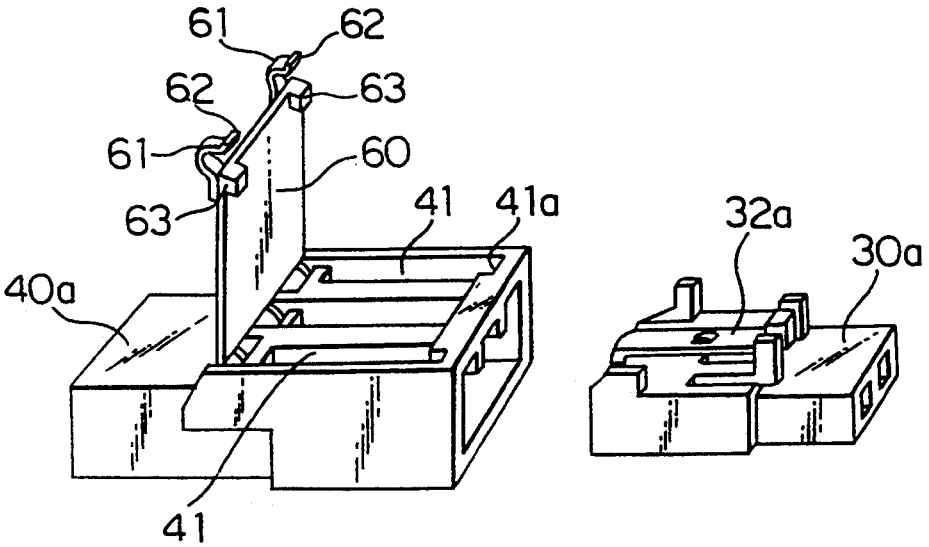
RELATED ART FIG. 2
FIG. 2 is a disassembled perspective view of a connector assembly with a connection confirmation mechanism according to another related art.
Figure 3:
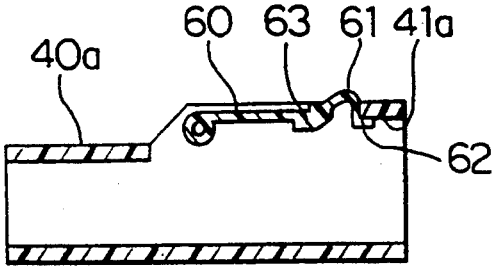
FIG. 3 is a cross-sectional view of the female connector shown in FIG. 2.
Figure 4:
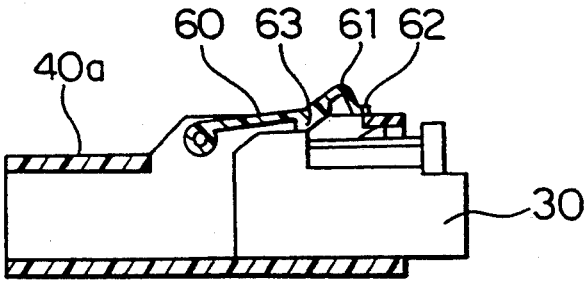
RELATED ART FIG. 4
FIG. 4 is a schematic cutaway cross-sectional view showing the state of use of the connector assembly shown in FIG. 2.
Figure 5:
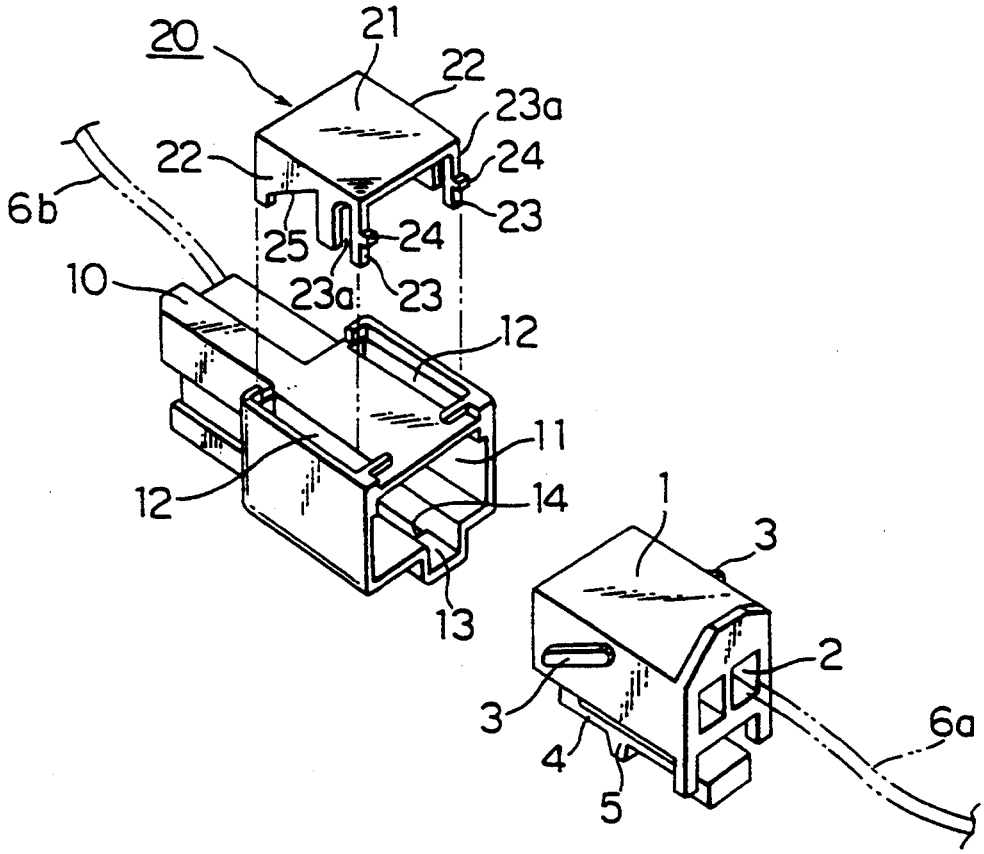
FIG. 5 is a disassembled perspective view of the connector assembly with a connection confirmation mechanism according to an embodiment of the present invention.

As shown in FIG. 5, the connector assembly with a connection confirmation mechanism according to the present embodiment has a male connector 1 and a female connector 10.

The male connector 1 has formed inside it a terminal enclosure 2. At the front ends of the two side surfaces there are formed inclined projections 3, 3 which incline upward from the front end to the base end side. At the bottom surface of the male connector 1, further, there is integrally formed a locking arm 4. On the bottom surface of the locking arm 4 there is formed an engagement projection 5. The locking arm 4 is able to bend upward and downward in a cantilever fashion about the portion connected with the male connector.

The male connector 1 formed integrally with this locking arm 4 is comprised of a plastic such as PBT (polybutylene terephthalate), nylon, and nylon with low water-absorbing power and is fabricated by, for example, injection molding.

The female connector 10 has formed in it a terminal enclosure, not shown. When the male connector 1 is connected with the female connector 10, the connector terminals are connected with each other. Note that while not shown in the drawings, the connectors 1 and 10 have connection terminals attached inside them. These connection terminals have the wire harnesses 6*a*, 6*b*, etc. connected to them. The connection terminals are comprised by female terminals and male terminals. Either of the terminals may be arranged in the male connector 1, with the other terminal being arranged in the female connector 10.

The wire harnesses 6*a* and 6*b* are electrically connected by the connection of the two connectors 1 and 10. For example, in wiring for the electrical system of an automobile, it is important that the connectors be reliably connected and a structure of a connector is desired in which the connection can be confirmed.

As shown in FIG. 5, the female connector 10 has a connection opening 11 formed in it into which the front end of the male connector 1 is fit. The two side portions of the top surface of the female connector 10 have insertion holes 12 formed in them communicating with the connection opening 11. The insertion holes 12 have the two side plates 22 of the lock member 20 inserted in them. The lock member 20 is able to move upward and downward with respect to the female connector 10.

At the approximate center of the bottom surface of the connection opening 11 of the female connector 10 there is formed a connection groove 13 running in the longitudinal direction of the connector 10. In the middle of the connector groove 13 in the longitudinal direction is formed an engagement step 14. This engagement step 14 engages with the engagement projection 5 of the locking arm 4 when the male connector 1 is fit in the female connector 10.

Figure 6:
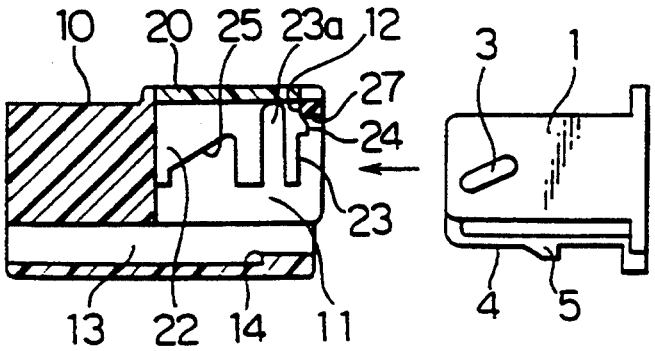
FIG. 6, FIG. 7, FIG. 8, and FIG. 9 are schematic cutaway cross-sectional views showing the state of use of the connector assembly shown in FIG. 5.

The lock member 20 attached to the top surface of the female connector 10 has a top plate 21 and side plates 22 formed at its two sides projecting downward. The side plates 22 are formed with slits 23a extending in the vertical direction and engagement grooves 25. The slits 23*a* are formed at the front ends of the side plates 22. The front ends of the side plates 22 also have columnar elastic engagement pieces 23 formed on them. At the surfaces of the front ends of the elastic engagement pieces 23 are formed engagement pawls 24. The engagement pawls, as shown in FIG. 6, engage with the bottom surfaces 27 of the front edges of the openings of the insertion holes 12 when the side plates 22 of the lock member 20 are completely inserted in the insertion holes 12 of the female connector 10 (when pushed down). The positions of the bottom surfaces 27 of the front edges of the openings of the insertion holes 12 may be designed anywhere.

The engagement grooves 25 formed in the side plates 22 are formed with widths somewhat larger than the axial direction widths of the inclined projections 3 formed at the sides of the male connector 1. The top edges of the engagement grooves 25 are made to incline in accordance with the inclination of the inclined projections 3.

The female connector 10 and the lock member 20 are comprised of PBT nylon, nylon with low water-absorbing power, or other plastics and are formed for example by injection molding. Note that the female connector 10 and the lock member 20 may be the same color, but are desirably colored differently from the viewpoint of facilitating visual recognition. For example, when coloring the female connector 10 red, the lock member 20 may be colored yellow, thereby giving a combination of colors which enables clear discrimination between the two. This is because the double locking is confirmed by the projection of the lock member 20 from the female connector 10.

In the connector assembly with a connection confirmation mechanism according to this embodiment, in the state before fitting together the male connector 1 and the female connector 10, as shown in FIG. 6, the side plates 22 of the lock member 20 attached to the female connector 10 are completely pushed down in the insertion holes 12 of the female connector 10 and the engagement pawls 24 of the elastic engagement pieces 23 are made to engage with the edges of the insertion holes 12.

As a result, the lock member 20 does not project out from the top surface of the female connector 10 and further is affixed by the engagement of the engagement pawls 24, so the lock member 20 does not get in the way during transportation of the connector, during the work for arranging the wire harness 6*b* connected to the female connector 10, etc. and it is possible to prevent damage to the lock member.

Figure 7:
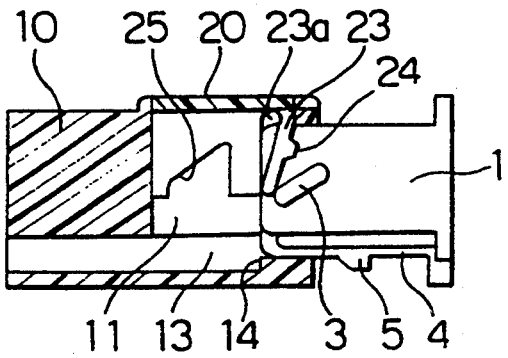
Figure 8:
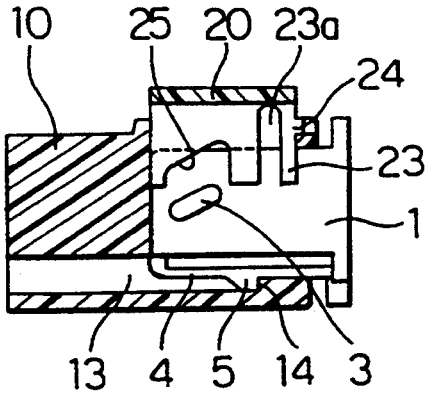

In this state, when the front end of the male connector 1 is fit into the connection opening 11 provided in the female connector 10, as shown in FIG. 7, the elastic engagement pieces 23 provided on the lock member 0 are pushed backward and bent by the front ends of the inclined projections 3, 3 provided at a slant at the two side surfaces of the front end of the male connector 1. The engagement pawls 24 formed at the elastic engagement pieces 23 are released from the inside edges of the insertion holes 12 made in the top surface of the female connector 10. As a result, the spring back force of the elastic engagement pieces 23 causes the lock member 20 to spring upward. At the same time, the elastic engagement pieces 23 are pushed up along the inclined top surface of the inclined projections 3 formed at the front ends of the two side surfaces of the male connector 1. When the lock member 20 rises completely, as shown in FIG. 8, the engagement pawls 24 provided at the elastic engagement pieces 23 engage with the outer edges of the insertion holes 12 formed in the top surface of the female connector 10, and the lock member 20 is held in a state projecting upward from the top surface of the female connector 10.

Figure 9:
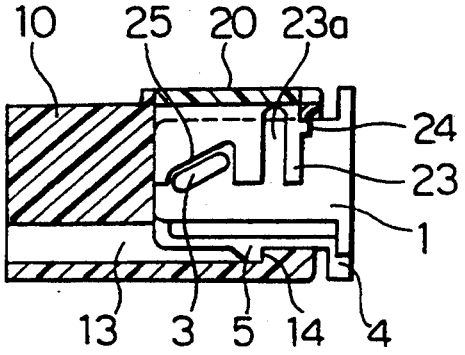

When the two connectors 1 and 10 are completely connected and the engagement projection 5 formed at the locking arm 4 of the male connector 1 is engaged with the engagement step 14 formed at the bottom surface of the connection groove 13 provided in the female connector 10, the locking member 20 is pushed down. When this is done, as shown in FIG. 9, the inclined projections 3, 3 of the male connector i fit into and engage with the engagement grooves 25 formed in the two side plates 22, 22 of the lock member 20, the two connectors 1 and 10 are doubly locked, and inadvertent disconnection is completely prevented.

Further, when the two connectors 1 and 10 are not completely connected, the front end surfaces of the two side plates 22, 22 of the lock member 20 abut against the top surfaces of the inclined projections 3, 3 provided at the male connector 1, so the lock member 20 cannot be pushed down. Accordingly, during connection work, it is possible to extremely easily visually detect incomplete connection of the two connectors 1 and 10. Further, even if forgetting to push down the lock member 20 and doubly lock the two connectors 1 and 10, this can be extremely easily visually detected, since the lock member 20 projects upward from the top surface of the female connector 10.

By providing the inclined projections 3 inclined upward at the front ends of the two side surfaces of the male connector 1, it is possible to push up the lock member 20 to the same extent as the height dimension of the side surface of the male connector 1. Accordingly, it is possible to extremely easily detect when the two connectors 1 and 10 are not completely connected or when the two connectors 1 and 10 are not doubly locked by the lock member 20, since the lock member 20 projects upward a large amount from the top surface of the female connector 10.

Note that in the above embodiment, the two side plates 22, 22 of the lock member 20 were provided with elastic engagement pieces 23 having engagement pawls 24 and the engagement grooves 25, but the present invention is not limited to this embodiment.

Figure 10:
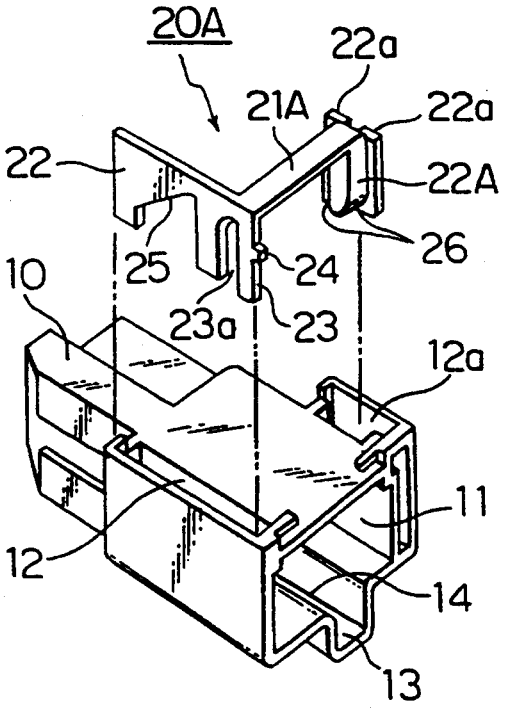
FIG. 10 is a disassembled perspective view of the connector assembly with a connection confirmation mechanism according to another embodiment of the present invention.

For example, the connector assembly with a connection confirmation mechanism shown in FIG. 10 also falls in the scope of the present invention. In the embodiment shown in FIG. 10, the side plate 22 extending downward from one of the sides of the top plate 21A of the lock member 20A is made similar to that in the above embodiment, while a downward extending guide rod 22A is formed at the other side. Guide sleeve pieces **22*a*, 22*a* are provided at the two dies of the guide rod 22A. The inclined projection 3 of the male connector 1 shown in FIG. 5 abuts against the bottom end of the guide rod 22A, so it is preferable to form a guide taper 26**.

At the side surface of the connection opening 11 provided in the female connector 10, there is provided a guide hole **12*a* in which the guide sleeve pieces 22*a* and 22*a* may slidingly fit. The lock member 20 is movable up and down with respect to the female connector 10**. The rest of the configuration is the same as in the above embodiment. Common members are given common reference numerals and explanations of the same are omitted.

Even with the connector assembly with a connection confirmation mechanism according to the embodiment shown in FIG. 10, there is the same action as the above embodiment. In particular, in the connector assembly of the embodiment shown in FIG. 10, an elastic engagement piece 23 and engagement groove 25 are formed at only the side plate 22 of one side of the lock member **20*a***, so it is possible to make the component small.

Figure 11:
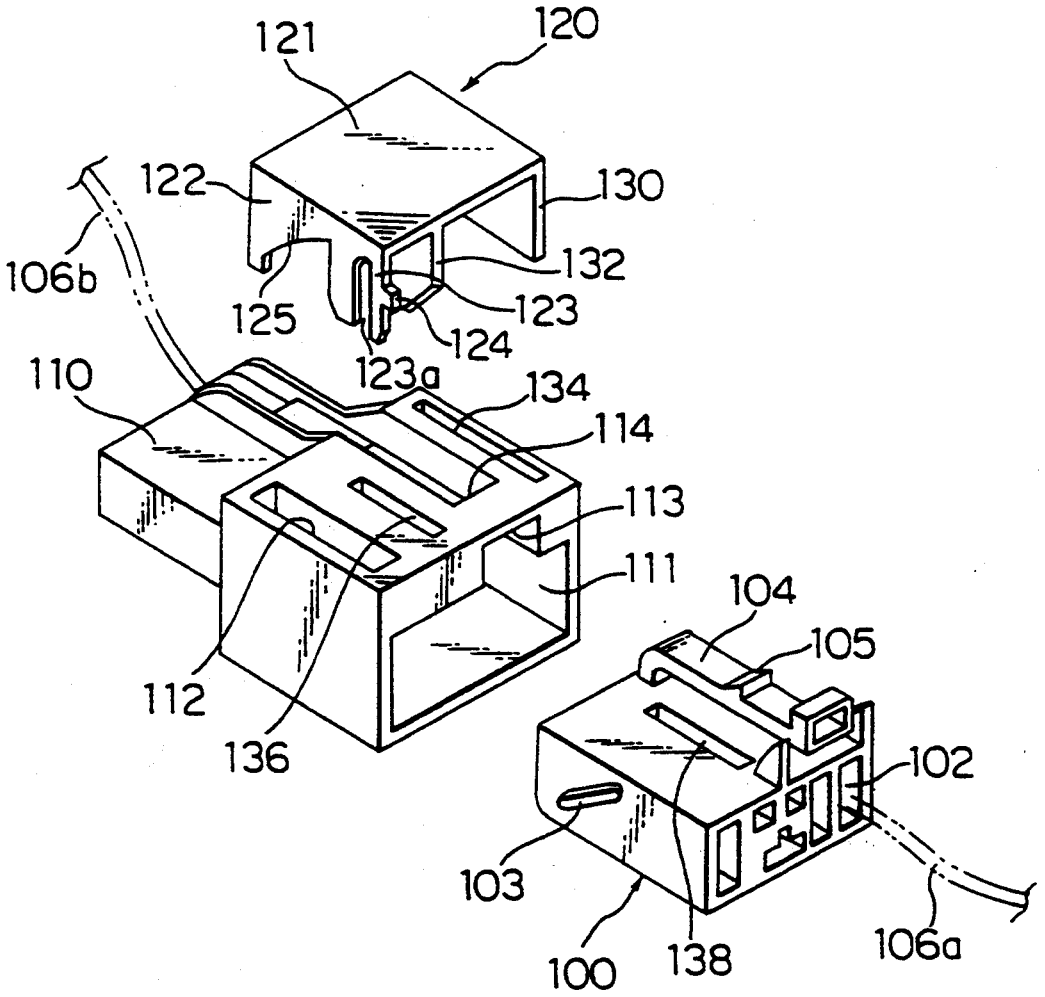
FIG. 11 is a disassembled perspective view of the connector assembly with a connection confirmation mechanism according to further another embodiment of the present invention.

FIG. 11 shows another embodiment of the present invention.

As shown in FIG. 11, the connector assembly with a connection confirmation mechanism according to the embodiment has a male connector 100 and a female connector 110.

The male connector 100 has formed inside it a terminal enclosure 102. At the front end of the one side surface there are formed inclined projections 103 which incline upward from the front end to the base end side. At the top surface of the male connector 100, further, there is integrally formed a locking arm 104. On the top surface of the locking arm 104 there is formed an engagement projection 105. The locking arm 104 is able to bend upward and downward in a cantilever fashion about the portion connected with the male connector.

The male connector 100 formed integrally with this locking arm 104 is comprised of a plastic such as PBT, nylon, and nylon with low water-absorbing power and is fabricated by, for example, injection molding.

The female connector 110 has formed in it a terminal enclosure, not shown. When the male connector 100 is connected with the female connector 110, the connector terminals are connected with each other. Note that while not shown in the drawings, the connectors 100 and 110 have connection terminals attached inside them. These connection terminals have the wire harnesses **106*a*, 106*b*, etc. connected to them. The connection terminals are comprised by female terminals and male terminals. Either of the terminals may be arranged in the male connector 100, with the other terminal being arranged in the female connector 110**.

The wire harnesses **106*a* and 106*b* are electrically connected by the connection of the two connectors 100 and 110**. For example, in wiring for the electrical system of an automobile, it is important that the connectors be reliably connected and a structure of a connector is desired in which the connection can be confirmed.

As shown in FIG. 11, the female connector 110 has a connection opening 111 formed in it into which the front end of the male connector 100 is fit. The one side portion of the top surface of the female connector 110 has insertion hole 112 formed in them communicating with the connection opening 111. Into the insertion hole 112 inserted a side plate 122 of the lock member 120. The lock member 120 is able to move upward and downward with respect to the female connector 110. The other side portion of the top surface of the the female connector 110 has guide hole 134. Into the guide hole inserted a guide plate of the lock member. Further, the female connector 110 has a through hole 136 on the top surface between the insertion hole 112 and the guide hole 134. Into the through hole inserted a lock plate 132 of the lock member 120. The lock plate 132 may be inserted into a lock hole 138 which is formed on the top surface of the male connector 100, when the male connector 100 is fit in the female connector 110.

At the top surface of the connection opening 111 of the female connector 110 there is formed a connection groove 113 running in the longitudinal direction of the connector 110. In the way of the connector groove 113 in the longitudinal direction is formed an engagement step 114. This engagement step 114 engages with the engagement projection 105 of the locking arm 104 when the male connector 100 is fit in the female connector 110.

The lock member 120 attached to the top surface of the female connector 110 has a top plate 121 and the side plate 122 formed at its one side projecting downward. The side plate 122 is formed with slit **123*a* extending in the vertical direction and engagement groove 125. The slit 123*a* is formed at the front end of the side plate 122. The front end of the side plate 122 also has columnar elastic engagement piece 123 formed on it. At the surface of the front end of the elastic engagement piece 123 is formed engagement pawl 124. The engagement pawl 124 engages with the bottom surfaces of the front edge of the opening of the insertion hole 112 when the side plate 122 of the lock member 120 are completely inserted in the insertion hole 112 of the female connector 110** (when pushed down).

The engagement grooves 125 formed in the side plate 122 is formed with width somewhat larger than the axial direction width of the inclined projection 103 formed at the sides of the male connector 100. The top edge of the engagement groove 125 is made to incline in accordance with the inclination of the inclined projection 103.

The female connector 110 and the lock member 120 are comprised of PBT nylon, nylon with low water-absorbing power, or other plastics and are formed for example by injection molding. Note that the female connector 110 and the lock member 120 may be the same color, but are desirably colored differently from the viewpoint of facilitating visual recognition. For example, when coloring the female connector 110 red, the lock member 120 may be colored yellow, thereby giving a combination of colors which enables clear discrimination between the two. This is because the double locking is confirmed by the projection of the lock member 120 from the female connector 110.

Even with the connector assembly with a connection confirmation mechanism according to the embodiment shown in FIG. 11, there is the same action as the above embodiments.

According to the present invention, as explained above, there is the advantage that it is possible to extremely easily visually detect incomplete connection of the female and male connectors and double locking of the female and male connectors.

I claim:

1. A connector assembly with a connection confirmation mechanism having a male connector and a female connector, wherein the male connector has formed on it an inclined projection which is formed at least at one side surface of the male connector and which inclines upward from a front end of the male connector to a base end, the female connector has formed in it a connection hole into which the front end of the male connector is inserted and insertion holes communicating with the inside of the connection hole, a lock member has formed on it side plates which fit into the insertion holes of the female connector so that the lock member is attached vertically movably with respect to the female connector, and the side plates have formed on them elastic engagement pieces which elastically deform upon abutting with the inclined projections of the male connector and push up the lock member from the female connector by the abutting with the inclined projections and engagement grooves which enable the lock member to be pushed down into the female connector when the male connector is fit into the female connector and which enable engagement with the inclined projections.

2. The connector assembly with a connection confirmation mechanism as set forth in claim 1, wherein the elastic engagement pieces have formed on them engagement pawls which engage with the bottom surfaces of the front opening edges of the insertion holes when the lock member is pushed down into the female connector and engages with the top surfaces of the front opening edges of the insertion holes when the lock member is pushed up from the female connector.

3. The connector assembly with a connection confirmation mechanism as set forth in claim 1 or 2, wherein the bottom surface of the male connector has formed on it a locking arm which bends in a cantilever fashion and has formed on it an engagement projection, the bottom side of the connection opening of the female connector has formed in it a connection groove for guiding the insertion of the locking arm, and the bottom surface of the connection groove has formed on it an engagement step for engaging with the engagement projection of the locking arm when the male connector is fit into the female connector.

4. The connector assembly with a connection confirmation mechanism as set forth in claim i or 2, wherein the top surface of the male connector has formed on it a locking arm which bends in a cantilever fashion and has formed on it an engagement projection, the top side of the connection opening of the female connector has formed in it a connection groove for guiding the insertion of the locking arm, and the top surface of the connection groove has formed on it an engagement step for engaging with the engagement projection of the locking arm when the male connector is fit into the female connector.

5. The connector assembly with a connection confirmation mechanism as set forth in claim 1 wherein at least one side of the male connector has the inclined projection formed on them.

6. The connector assembly with a connection confirmation mechanism as set forth in claim 1 or 2, wherein a pair of the side plates of the lock member are formed extending downward from two sides of a top plate of the lock member.

7. The connector assembly with a connection confirmation mechanism as set forth in claim 1 or 2, wherein the side plate of the lock member is formed to extend downward from one side of a top plate of the lock member, a downward extending guide rod is formed at the other side of the top plate, and the female connector is provided with a guide hole for guiding the guide rod.

8. The connector assembly with a connection confirmation mechanism as set forth in claim 7, wherein the bottom end of the guide rod has formed on it a guide taper for abutting against the inclined projection of the male connector.

9. The connector assembly with a connection confirmation mechanism as set forth in claim 1 or 2, wherein the lock member and the female connector are made different in color.

* * * * *